US005993361A

United States Patent [19]

Paoli et al.

[11] Patent Number: 5,993,361

[45] Date of Patent: Nov. 30, 1999

[54] MULTI-CONFIGURABLE EXERCISE APPARATUS

[76] Inventors: Paul W. Paoli, 108 Brook Ave., Staten Island, N.Y. 10306; William Harvey, 41-03 10$^{th}$ St., Apartment 6B, Long Island City, N.Y. 11101

[21] Appl. No.: 09/065,778

[22] Filed: Apr. 23, 1998

[51] Int. Cl.$^{6}$ ..... A63B 21/02

[52] U.S. Cl. ..... 482/121; 482/126; 482/129; 482/49

[58] Field of Search ..... 482/49, 139, 121–130

[56] References Cited

U.S. PATENT DOCUMENTS

| | | | |
|---|---|---|---|
| 699,401 | 5/1902 | Lott | 482/126 |
| 4,591,150 | 5/1986 | Moshar | 482/121 |
| 4,783,067 | 11/1988 | Palmer | 482/121 |
| 5,125,878 | 6/1992 | Wingat et al. | 482/49 |

*Primary Examiner*—Jerome W. Donnelly
*Attorney, Agent, or Firm*—Dilworth & Barrese

[57] ABSTRACT

A portable, multi-configurable exercise apparatus including a first pair of parallel spaced elongate rigid members having an outer and an inner rigid member and a second pair of parallel spaced elongate rigid members having an outer and an inner rigid member. The first pair of elongate rigid members being coupled to the second pair of elongate rigid members by a pair of elongate guide members parallel spaced and transverse to the first and second pairs of rigid members. The outer and inner rigid members of each pair of rigid members being separated by at least one elastic member for providing variable resistance between each inner member and respective outer member. An alternate embodiment discloses a first pair of parallel spaced elongate rigid members and a second pair of elongate rigid members including a first and second rigid member, wherein the second pair of elongate rigid members are disposed between the first pair of elongate rigid members. The first pair of elongate rigid members is coupled to the second pair of elongate rigid members by locking guide members. Each first and second rigid member having at least one transversely coupled fastening guide member. The fastening guide members being separated by at least one elastic member for providing variable resistance between the first and second rigid members.

19 Claims, 16 Drawing Sheets

MULTI-CONFIGURABLE EXERCISE APPARATUS

BACKGROUND

1. Technical Field

The present disclosure generally relates to isometric exercising apparatuses, and, more particularly, to a portable, multi-configurable exercise apparatus and associated physical exercises for strengthening muscles through a series of pushing and pulling movements.

2. Background of Related Art

An individual may wish to strengthen the muscles of the upper body to provide added mobility, greater strength and improved physique. To achieve this, an individual may employ the use of well known muscle strengthening machines such as a bench press, a barbell curling platform, a pull-down bar press and other similar machines. Typically these muscle strengthening machines are costly, take up a lot of space and are complicated in use. Additionally, to properly exercise and strengthen the body requires an exercise routine which includes the use of many different exercise machines. This not only requires a great deal of time but may also initiate boredom in the individual who therefore may forego completing the entire exercise routine.

The present disclosure is directed to an improved portable, multi-configurable exercise apparatus for isometric developing and strengthening of muscles within the upper body of a person. The exercise apparatus easily converts into multiple configurations wherein each configuration is specifically directed to strengthening particular muscles groups. The exercise apparatus is also durably constructed and manufactured from lightweight materials. Assembly of the exercise apparatus into each specific configuration is facilitated by pre-formed members and fittings sized to be easily mounted to together.

The use of portable strength building exercise machines are well known in the prior art. These devices are mainly designed and marketed for a particular muscle group and at best provide varying results. In addition, many of these devices are difficult to assemble.

In this respect, the portable, multi-configurable exercise device according to the present disclosure substantially departs for conventional concepts and designs of the prior art, and in doing so provides an apparatus which is particularly well suited in solving the inadequacies of the exercise machines of the prior art.

Therefore, it can be appreciated that there exists a need for a new and improved portable, multi-configurable exercise apparatus which can be used for developing and strengthening muscles groups of the upper body as well as providing an improved overall physique.

The embodiments herein disclosed throughout the present disclosure achieve the intended purposes, objects, and advantages through a new, useful and unobvious combination of component elements, with the use of a minimum number of functioning parts, at a reasonable cost to manufacture, and by employing readily available materials.

SUMMARY

The present disclosure is directed to an improved exercise apparatus for isometric developing and strengthening of muscles of the upper body of a person. The exercise apparatus is designed to easily convert into multiple configurations, each directed to specific muscle groups. The durable, lightweight, pre-formed construction of the exercise apparatus facilitates the assembly of each specific exercise configuration.

Accordingly, a portable, lightweight, multi-configurable apparatus for developing and strengthening the muscles of the upper body is disclosed. The apparatus includes a first pair of parallel-spaced elongate rigid members including an outer and an inner rigid member and a second pair of parallel-spaced elongate rigid members including an outer and an inner rigid member. The first pair of elongate rigid members is coupled to the second pair of elongate rigid members by a pair of elongate guide members, parallel spaced and transverse to both the first and second pairs of rigid members. The guide members completely transect at least two rigid members and are fixedly attached to at least two rigid members. The rigid and guide members are substantially circular in cross-section, wherein each rigid member is substantially equal in both cross-section and length. The outer and inner rigid members are separated by at least one elastic member which provides variable resistance between each inner member and respective outer member.

The exercise apparatus preferably includes a strap coupled to at least one of the outer rigid members, as well as, a cushioned support along at least one of the outer rigid members. The strap includes a padded section for providing support for a user of the exercise apparatus.

The exercise apparatus preferably includes at least one attachment member coupled to at least one pair of elongate rigid members. Each attachment member having a pad for providing support to a user of the exercise apparatus.

Also, disclosed is a multi-configurable exercise apparatus including a first pair of parallel spaced elongate rigid members and a second pair of elongate rigid members including a first and second rigid member, wherein the second pair of elongate rigid members are disposed between the first pair of elongate rigid members. The first pair of elongate rigid members are rotationally coupled to the second pair of elongate rigid members by locking guide members. The first and second rigid members including at least one transversely coupled fastening guide member, wherein each fastening member is separated by at least one elastic member for providing variable resistance between the first and second rigid members.

The exercise apparatus preferably includes each rigid and guide member being substantially circular in cross-section and including upper and lower grasping ends, wherein a grasping force is applied to at least two of the grasping ends to perform each physical exercise. The grasping force required to perform each specific exercise will either draw the at least two grasping ends toward each other or away from each other.

An alternate multi-configurable exercise apparatus includes a pair of parallel spaced elongate rigid members including a first and second rigid member, wherein an attachment member is transversely coupled to at least one of the rigid members. The first and second rigid members are separated by at least one elastic member for providing variable resistance between the first and second rigid members.

The exercise apparatus preferably includes a strap coupled to at least one of the rigid members and a pad coupled to the attachment member for providing support to a user of the exercise apparatus.

BRIEF DESCRIPTION OF THE DRAWINGS

The objects and features of the present disclosure, which are believed to be novel, are set forth with particularity in the appended claims. The present disclosure, both as to its organization and manner of operation, together with further objectives and advantages may best be understood by reference to the following description, taken in connection with the accompanying drawings, in which:

DETAILED DESCRIPTION OF PREFERRED EMBODIMENTS

Figure 1:
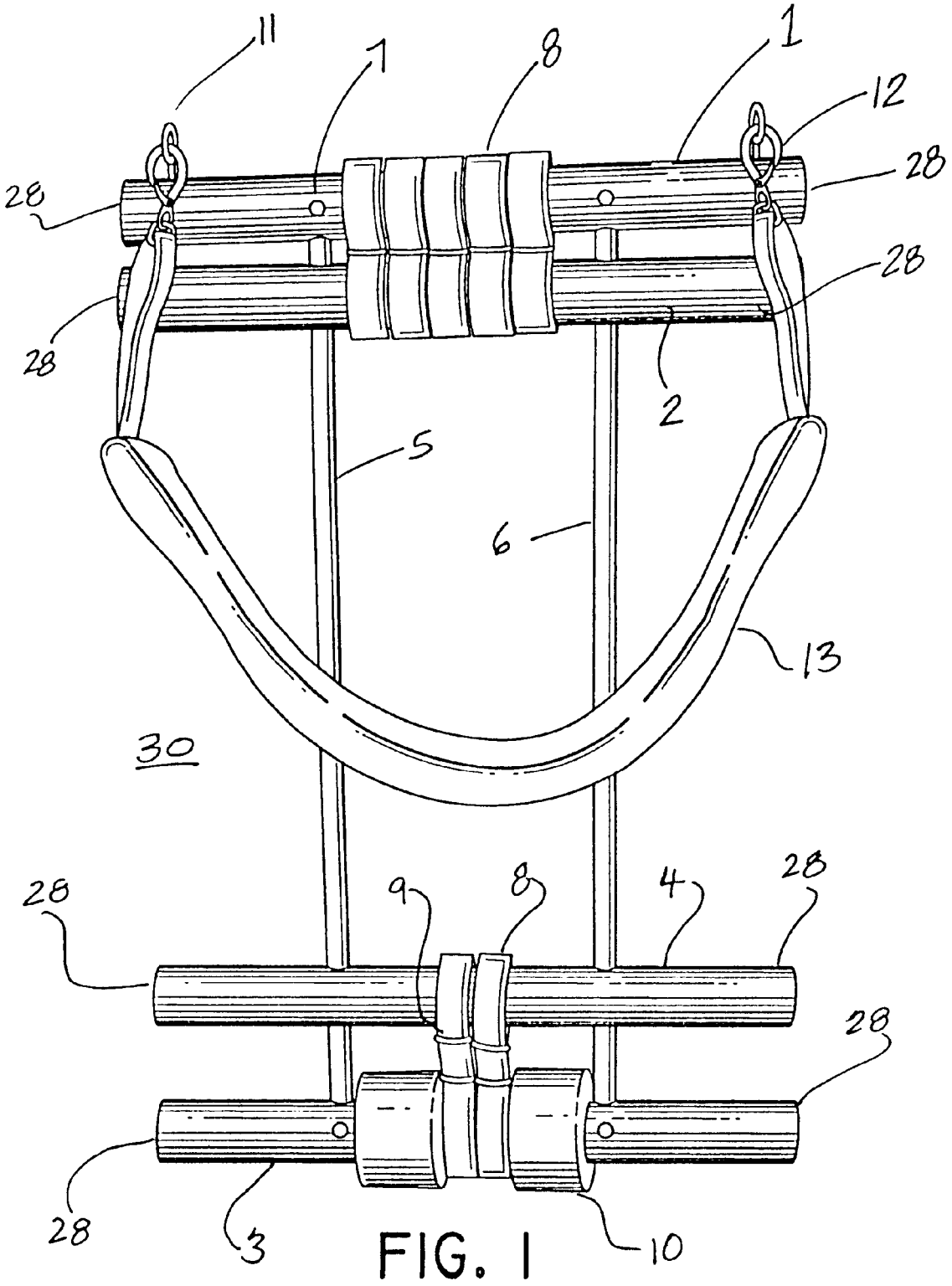
FIG. 1 is a perspective view illustrating an exercise apparatus of one embodiment according to the present disclosure.

Reference will now be made in detail to the preferred embodiments of the disclosure, which are illustrated in the accompanying figures. Turning now to the figures, wherein like components are designated by like reference numerals throughout the various figures, attention is first directed to FIGS. 1–2.

Figure 2:
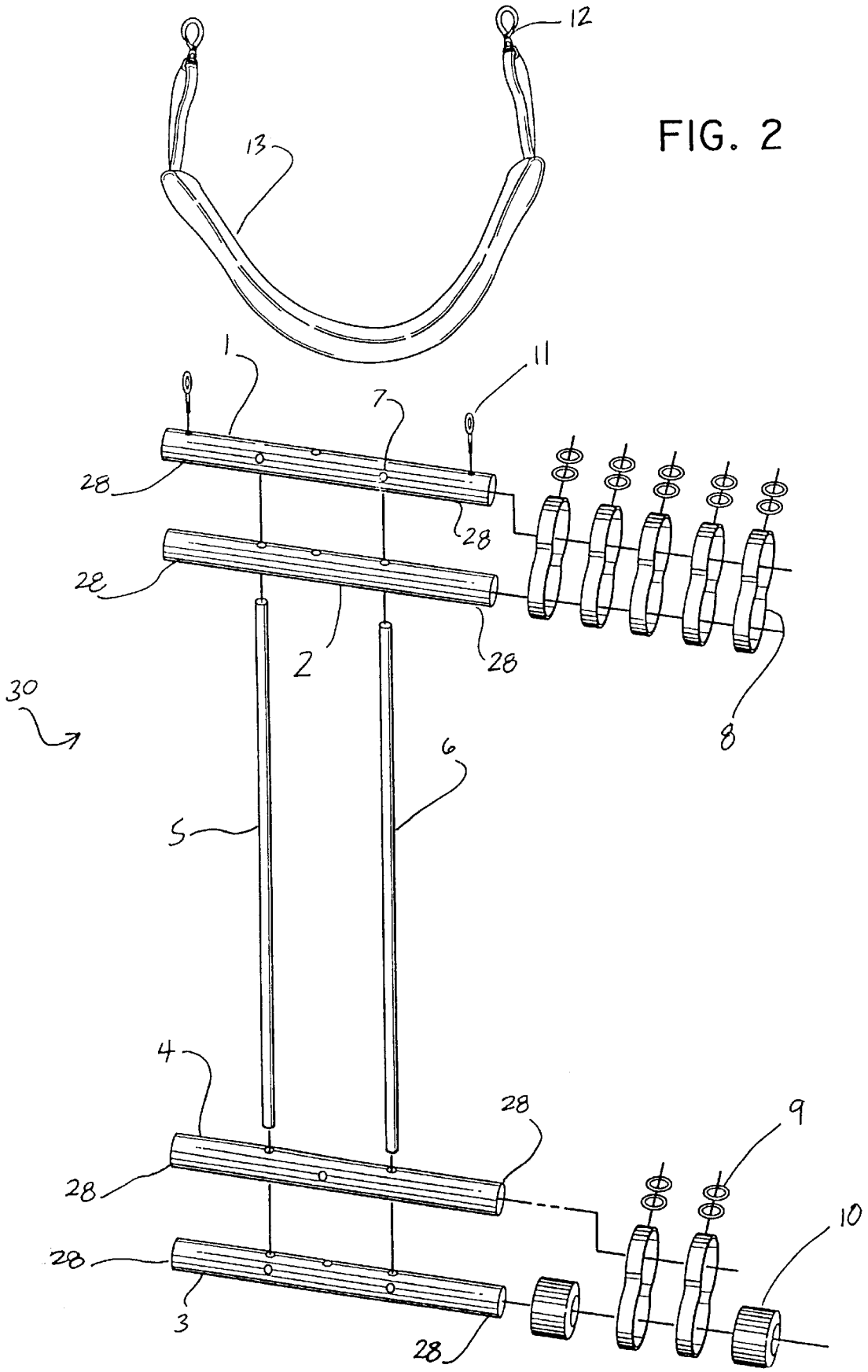
FIG. 2 is a perspective view with parts separated of the exercise apparatus embodiment of FIG. 1.

A multi-configurable exercising apparatus 30 incorporating the present disclosure is generally shown in FIGS. 1–2. A first pair of elongate rigid members 1 and 2 and a second pair of elongate rigid members 3 and 4 are coupled to each other through elongate guide members 5 and 6. The elongate rigid members 1–4 are generally cylindrical in shape to provide for a comfortable and frictional hand grip, although other geometrical shapes including rectangular and ergonomically designed shapes which conform to the shape of a user's hand or body part are also contemplated. The elongate rigid members 1–4 may also include gripping surfaces along their outer surfaces which will enhance gripping of the rigid members 1–4. These gripping surfaces may also include padding and be manufactured from materials such as rubber, foam, cloth, leather and the like.

Rigid members 1 and 3 are provided with spaced partial bores for receiving ends of guide members 5 and 6. Similarly, rigid members 2 and 4 include spaced through holes for completely passing guide members 5 and 6 when the guide members are insertably mounted through rigid members 2 and 4 and into the partial bores of rigid members 1 and 3. Once attached, rigid members 2 and 4 are disposed within the outer confines of rigid members 1 and 3 and can freely slide along guide members 5 and 6. Rigid members 1 and 3 further include two spaced through holes or peg bores positioned to transversely bisect the partial cavities of rigid members 1 and 3, wherein the peg bores in conjunction with peg members 7 are used for fixedly attaching guide members 5 and 6 to rigid members 1 and 3. Correspondingly, guide members 5 and 6 include peg bores at either end points for fixedly mounting to rigid members 1 and 3 through peg members 7. Peg members 7 are preferably solid, cylindrically shaped pegs which fully accommodate their respective circular peg bores. It is also contemplated that the peg members 7 of the present disclosure can be substituted with other similar connecting members such as, but not limited to, cotter-type pins, nut and bolt, wing nut and bolt, screw members and other pin-type devices. Peg members 7 are driven or tapped into the peg bores of rigid members 1 and 3 and through the corresponding peg bores of the guiding members 5 and 6 to fixedly attach the guide members 5 and 6 to the rigid members 1 and 3.

A plurality of elastic members 8 are placed over rigid member pairs (1, 2) and (3, 4). Elastic members 8 can be of varied length and elasticity and the number of elastic members 8 used in conjunction with the embodiments disclosed herein is dependent upon the amount of elastic or resistance force required by the user of the particular exercise apparatus, wherein usage of a higher quantity of elastic members results in higher elastic or resistance force between the rigid or guide members held between the elastic members 8. Elastic members 8 are constructed of single or multiple layers of elastic material such as rubber or the like and employ the use of O-rings 9, as is shown specifically at FIG. 2. O-rings 9 are used to retain elastic members 8 in a desired position on the rigid or guide members while keeping elastic members 8 in a compact and uniform shape. In use, O-rings 9 are rolled over the longitudinal dimension of elastic members 8 and, once positioned along the elastic member 8, define separate elastic member loops. As is shown in FIGS. 1 and 2, elastic members 8 are divided by O-rings 9 to define at least two separate elastic member loops, which in turn are fitted over rigid members 1–4.

Rigid member 3 is fitted with a cushioning member 10. Cushioning member 10 is preferably annularly shaped with a bored center area for allowing passage of rigid member 3. As shown in FIGS. 1 and 2, cushioning member 10 includes two annularly shaped members separated by elastic members 8. In alternative embodiments, cushioning member 10 can include a single cylindrical shaped device having a bored center path for passage of rigid member 3 and further include an opening transverse to the bored center path for insertion of elastic members 8. In such embodiments, elastic members 8 are pre-inserted within the bored passage of cushioning member 10 so as to simultaneously accommodate the insertion of rigid member 3 through both the elastic members 8 and cushioning member 10. The outer end portions of rigid members 1–4 of the exercise apparatus 30 include grasping ends 28 which are physically gripped by a user during a particular exercise movement.

Rigid member 1 is further provided with additional through holes or bores for receiving annular shaped eyelet members 11, preferably made of steel or other similar material that provides sufficient strength and rigidity. The eyelet members 11 are used to attach strap pad harness 13 to exercise apparatus 30 which acts to support a user of exercise apparatus 30 during the performance of a particular exercise. Strap pad harness 13 includes a nylon strap core surrounded by a padded exterior. The nylon strap core is connected to rigid member 1 through snap hooks 12 and eyelet members 11. Each snap hook 12 includes a swivel base fixedly attached to the nylon strapping of strap pad harness 13 which allows for free movement of the rigid members assembly with resect to the strap pad harness 13.

Figure 3:
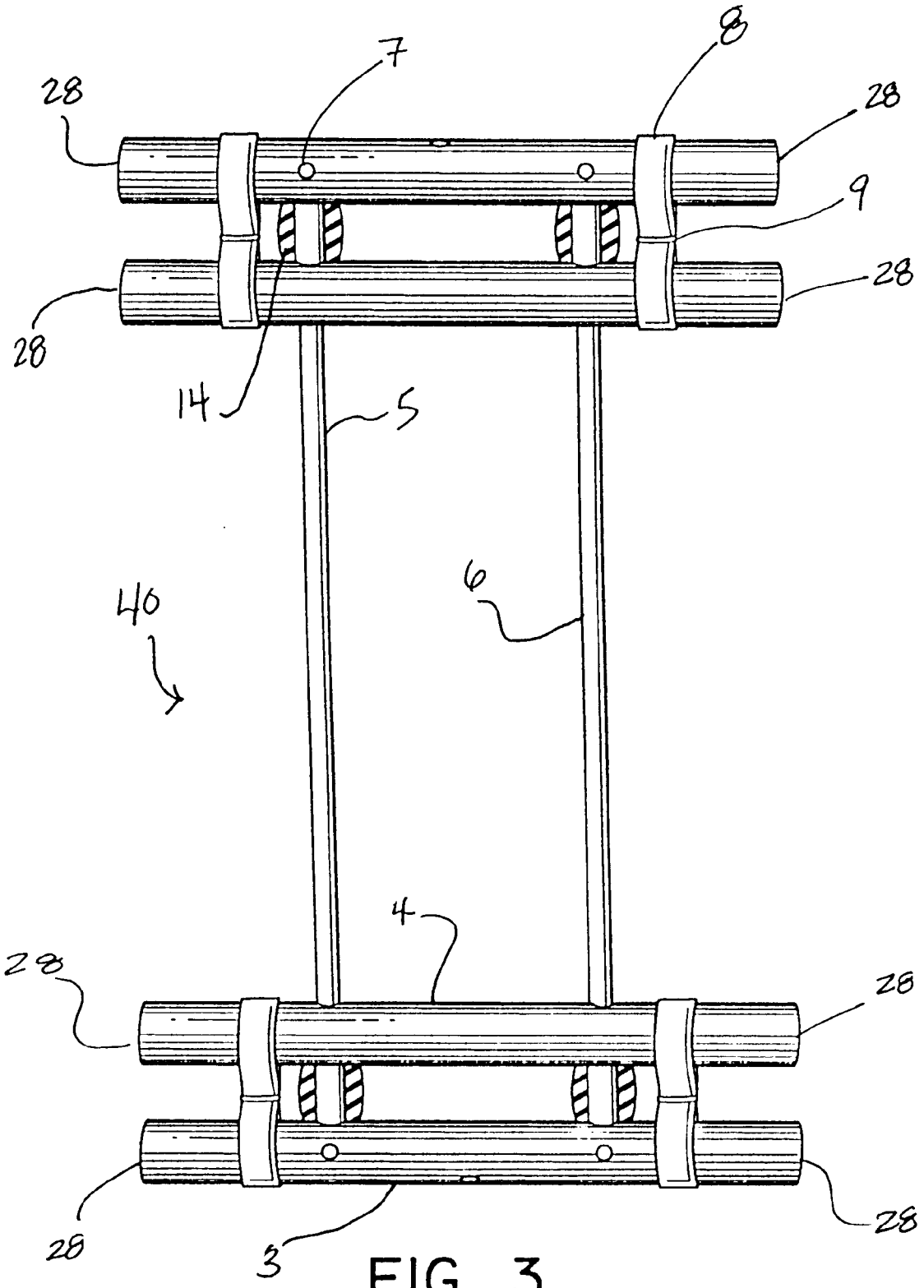
FIG. 3 is a perspective view illustrating an exercise apparatus of an alternative embodiment according to the present disclosure.

With reference to FIG. 3, an alternative embodiment of the present disclosure designated as exercise apparatus 40 is shown wherein like components which correspond to those of exercise apparatus 30 are designated by like reference numerals. Exercise apparatus 40 includes similar component structures as described in exercise apparatus 30. As such, guide members 5 and 6 are aligned into a parallel configuration so as to slidingly accept rigid members 2 and 4 via through holes centrally located through rigid members 2 and 4. Cylindrically shaped spacers 14 having longitudinal central bores are inserted through the end points of guide members 5 and 6. Spacers 14 are designed to be both elastic and provide shock absorbing characteristics and are preferably made of rubber or other similar material and may also be of a rectangular or spherical dimension. The spacers 14 are used to separate outer rigid member 1 from inner rigid member 2 and outer rigid member 3 from inner rigid member 4, as is shown if FIG. 3. The ends points of guide members 5 and 6 are insertably mounted into the partial cavities of rigid members 1 and 3. The rigid members 1 and 3 and guide members 5 and 6 include peg bores which are aligned for inserting peg members 7 to fixedly secure the rigid members 1 and 3 to guide members 5 and 6. Rigid members 2 and 4 are disposed within the outer confines of rigid members 1 and 3 and can freely slide along guide members 5 and 6. Rigid member 2 is oriented so that spacers 14 are disposed within an area between rigid member 1 and rigid member 2. Similarly, rigid member 4 is oriented so that spacers 14 are disposed within an area between rigid member 3 and rigid member 4. A plurality of elastic members 8 including corresponding O-rings 9 are inserted over rigid members 1 and 2 and rigid members 3 and 4 to form a variable resistive force of rigid member 2 with respect to rigid member 1, and similarly, rigid member 4 with respect to rigid member 3. O-rings 9 are fitted over elastic members 8 in the manner described in conjunction with exercise apparatus 30. The number of elastic members 8 used is dependent upon the varied resistance required by the user of the exercise apparatus 40. The outer end portions of rigid members 1–4 of the exercise apparatus 40 include grasping ends 28 which are physically gripped by a user during a particular exercise movement.

Figure 4:
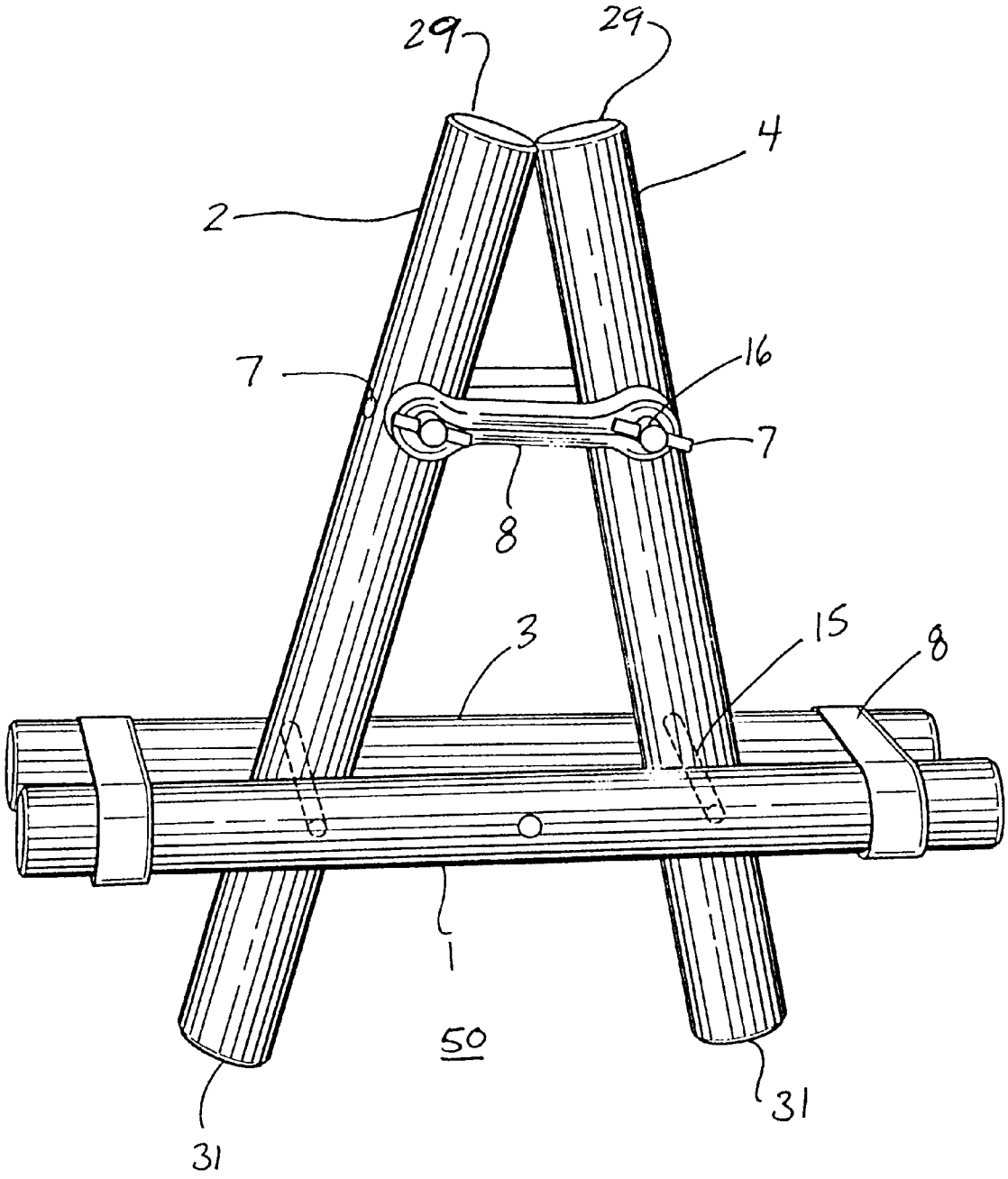
FIG. 4 is a perspective view illustrating an exercise apparatus of a still further embodiment according to the present disclosure.

An alternate embodiment of the exercise apparatus of the present disclosure is shown at FIG. 4 and designated as exercise apparatus 50. Exercise apparatus 50 includes a configuration of rigid members 1 and 3 being parallel spaced to form a gap and rigid members 2 and 4 being disposed within that gap while being rotationally fixed to rigid members 1 and 3. Rigid member 1 is fixedly attached to rigid member 3 by locking guide members 15 (shown in phantom) which include cylindrically shaped members having peg bores at either end for insertion of peg members 7. End points of locking guide members 15 are inserted into the partial bores of rigid member 1. The peg bores of the rigid member 1 and locking guide members 15 are aligned and peg members 7 are tapped or driven into the aligned bores to fixedly attach the locking guide members 15 to rigid member 1. Rigid members 2 and 4 via their respective through holes are inserted over the free ends of locking members 15. Rigid member 3 is then fixedly attached to the opposite end points of locking members 15 in the same manner as rigid member 1.

O-rings 9 are used on locking guide members 15 between each adjacent rigid member to provide frictional and elastic support between rotating adjacent rigid members. Elastic members 8 are placed over the parallel spaced rigid members 1 and 3 to further retain rigid members 2 and 4 in a secure rotational arrangement and allow for smooth rotation of rigid members 2 and 4 with respect to rigid members 1 and 3. Rigid members 2 and 4 are rotationally fixed to rigid members 1 and 3, as shown in FIG. 4, and include upper grasping ends 29, closest to fastening guide members 16, and lower grasping ends 31, closest to parallel spaced rigid members 1 and 3. The rigid members 2 and 4 are free for rotational displacement by a user of the exercise apparatus 50. Similarly, the outer end portions of rigid members 1 and 3 include end points for pushing or pulling against the user's body during a particular exercise movement. Fastening guide members 16 are inserted through respective through holes of rigid members 2 and 4 and are locked in place with the use of peg members 7 which are driven or tapped in a transverse arrangement to the fastening guide members 16. Fastening guide members 16 include a center peg bore which aligns with a peg bore of rigid members 2 and 4. The peg bores associated with rigid members 2 and 4 are transverse to the through holes which accommodates fastening guide members 16. These peg bores receive peg member 7 for fixedly attaching the fastening guide members 16 to the rigid members 2 and 4. A plurality of elastic members 8 are placed over the ends of fastening guide members 16 to provide a varying resistive force to the user of the exercise apparatus 50.

Figure 16:
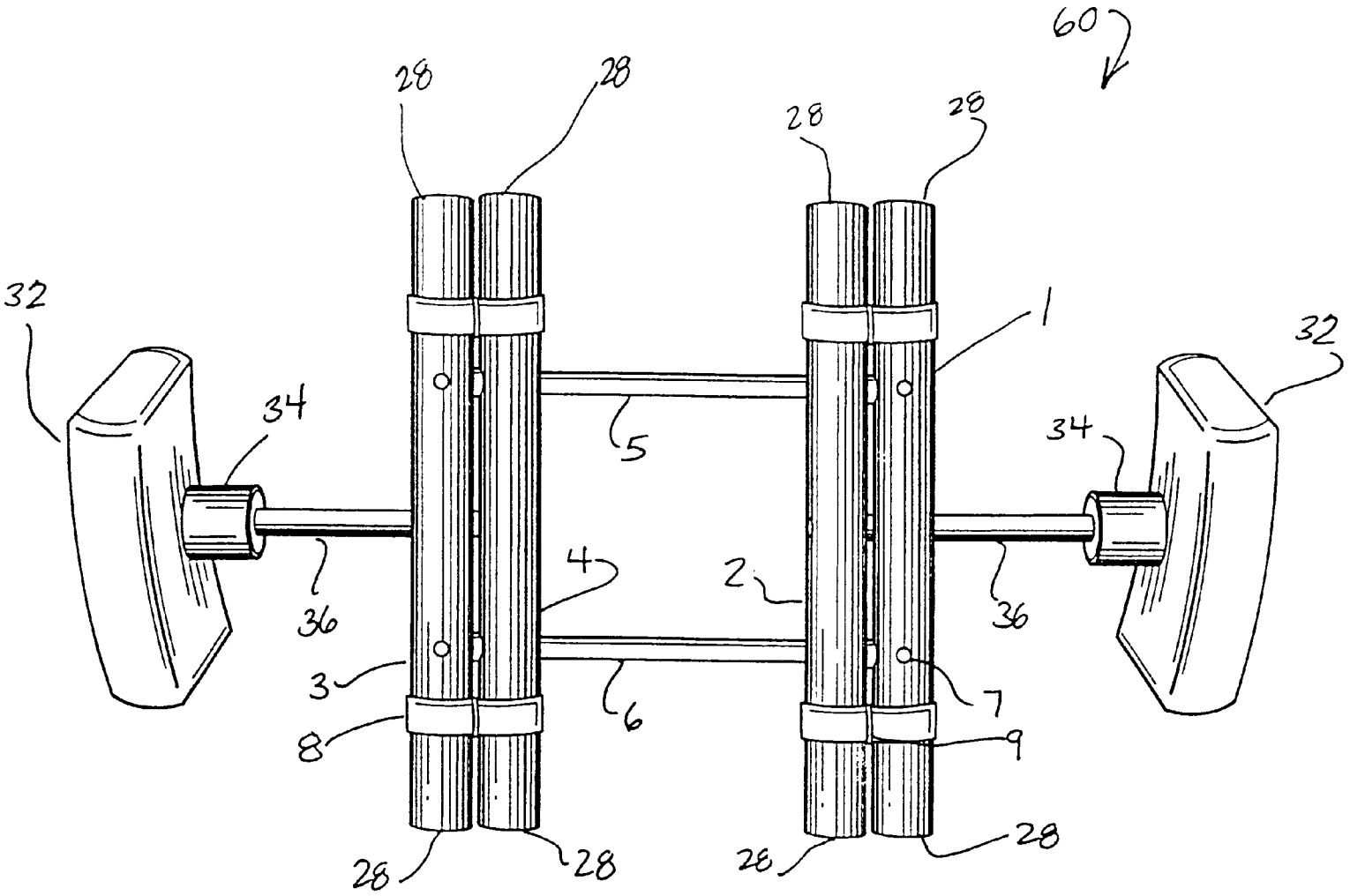
FIG. 16 is a perspective view illustrating an exercise apparatus of another embodiment according to the present disclosure.

In alternative embodiments described below, the exercise apparatuses of the present disclosure further include rigid members 1 and 3 having an additional central through hole for passing an attachment member 36 and rigid members 2 and 4 having a central partial bore used for insertion of attachment member 36. In such respects, reference is now made to FIG. 16 where an alternative embodiment of the present disclosure designated as exercise apparatus 60 is shown wherein like components which correspond to those of previously described exercise apparatuses are designated by like reference numerals. Exercise apparatus 60 includes similar component strictures as described in exercise apparatus 30. As such, guide members 5 and 6 are aligned into a parallel configuration so as to slidingly accept rigid members 2 and 4 via spaced through holes located through rigid members 2 and 4. The ends points of guide members 5 and 6 are insertably mounted into the partial cavities of rigid members 1 and 3. The rigid members 1 and 3 and guide members 5 and 6 include peg bores which are aligned for inserting peg members 7 to fixedly secure the rigid members 1 and 3 to guide members 5 and 6. Rigid members 2 and 4 are disposed within the outer confines of rigid members 1 and 3 and can freely slide along guide members 5 and 6. As shown in FIG. 16, two additional pad members 32 are secured to exercise apparatus 60. Pad members 32 include attachment grommets 34 and pad attachment members 36. Pad attachment members 36 are inserted through the central through holes of rigid members 1 and 3 into the partial central bores of rigid members 2 and 4. Pad attachment members 36 are frictionally secured to rigid members 2 and 4 but may also be secured with the use of peg bores and associated peg members 7 (not shown) positioned transversely through the partial central bores of rigid members 2 and 4. A plurality of elastic members 8 including corresponding O-rings 9 are inserted over rigid members 1 and 2 and rigid members 3 and 4 to form a variable resistive force of rigid member 2 with respect to rigid member 1, and similarly, rigid member 4 with respect to rigid member 3. O-rings 9 are fitted over elastic members 8 in the manner described in conjunction with the exercise apparatuses previously described. The number of elastic members 8 used is dependent upon the varied resistance required by the user of the exercise apparatus 60. The outer end portions of rigid members 1–4 of the exercise apparatus 60 include grasping ends 28 which are physically gripped by a user during a particular exercise movement.

Figure 18:
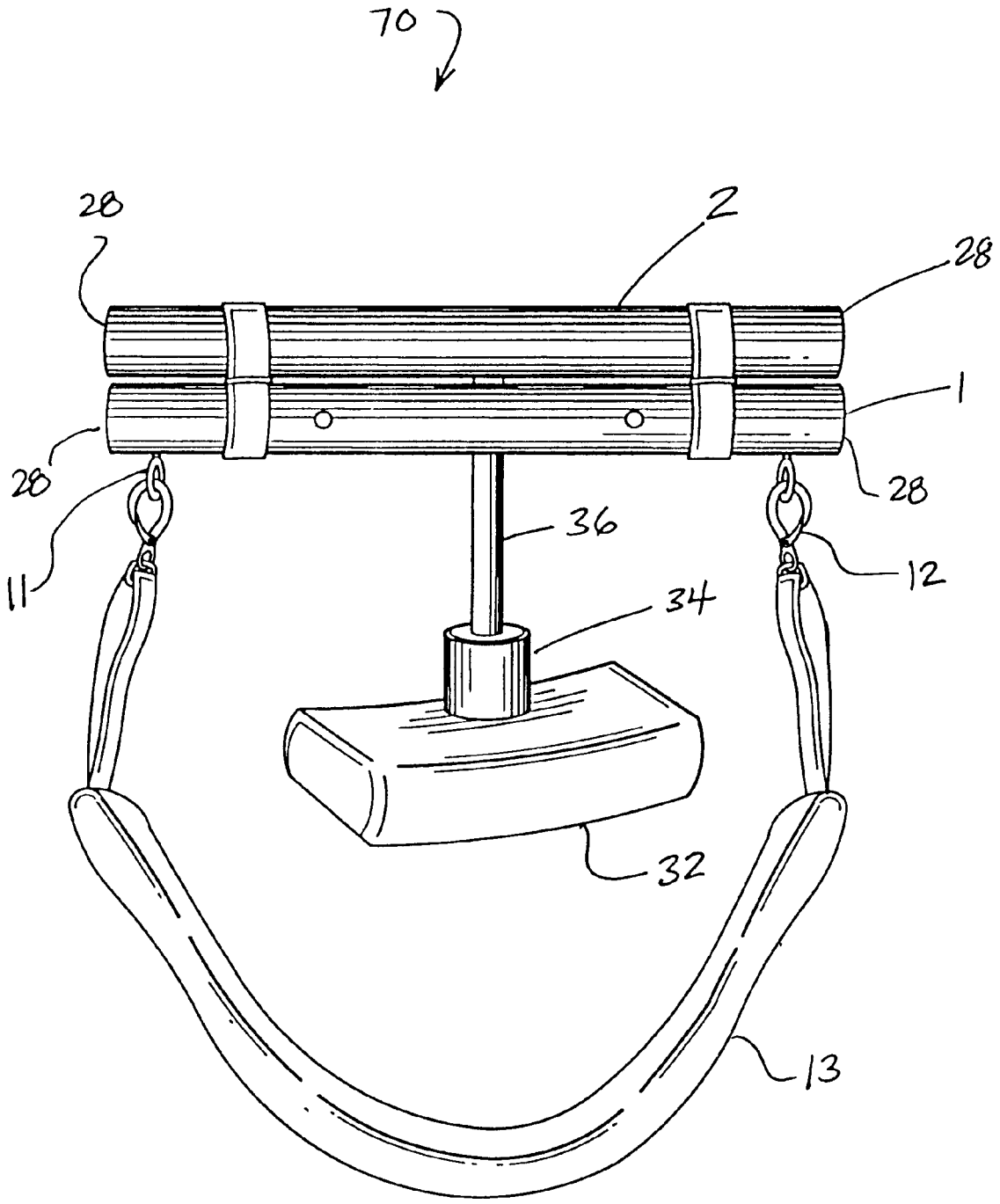
FIG. 18 is a perspective view illustrating an exercise apparatus of still another embodiment according to the present disclosure.

With particular reference to FIG. 18, an alternative embodiment of the present disclosure designated as exercise apparatus 70 is shown wherein like components which correspond to those of previously described exercise apparatuses are designated by like reference numerals. Exercise apparatus 70 includes similar component structures as described in exercise apparatus 60. As such, rigid members 1 and 2 are held in tension by a plurality of elastic members 8 including corresponding O-rings 9 are inserted over rigid members 1 and 2 to form a variable resistive force of rigid member 2 with respect to rigid member. A single pad member 32, as well as, corresponding grommet 34 and pad attachment member 36 are secured to exercise apparatus 70 in similar fashion as previously described exercise apparatus 60. Similarly, as previously described in exercise apparatus 30, rigid member 1 includes bores for receiving annular shaped eyelet members 11. The eyelet members 11 are used to attach strap pad harness 13 to exercise apparatus 70 which acts to support a user of exercise apparatus 70 during the performance of a particular exercise. Strap pad harness 13 includes a nylon strap core surrounded by a padded exterior. The nylon strap core is connected to rigid member 1 through snap hooks 12 and eyelet members 11. Each snap hook 12 includes a swivel base fixedly attached to the nylon strapping of strap pad harness 13 which allows for free movement of the rigid members assembly with resect to the strap pad harness 13.

Exercise apparatus 70 further includes O-rings 9 fitted over elastic members 8 in the mailer described in conjunction with the exercise apparatuses previously described. The number of elastic members 8 used is dependent upon the varied resistance required by the user of the exercise apparatus 70. Additionally, the outer end portions of rigid members 1 and 2 of the exercise apparatus 70 include grasping ends 28 which are physically gripped by a user during a particular exercise movement.

The exercise apparatus of the preferred embodiments include rigid members, guide members, peg members, snap hooks and eyelets preferably manufactured of lightweight durable materials such as aluminum, wood, metal alloys, composites, or PVC base components. The elastic members 8 are preferably double, continuous loops but may also include single or multiple loops of elastic material. The elastic material forming the elastic members 8 can be any material that is pliable and provides elastic resistance and attributes such as rubber and the like. The strap pad harness 13 assembly can be manufactured of nylon, PVC components, leather, foam rubber or any other suitable material.

The exercise apparatus of the present disclosure are specifically designed for physical exercises involving specific body parts and muscle groups. Each exercise apparatus 30, 40 and 50 is configured into a specific configuration, each of which is used to perform specific physical exercises. In the exercises described below, the person performing the physical exercises can vary the resistance of each configuration with respect to the person's body by applying a plurality of varying elastic members 8 having varying loop lengths and elastic resistance to the rigid and/or guide members of the exercise apparatuses 30, 40 and 50.

Figure 5:
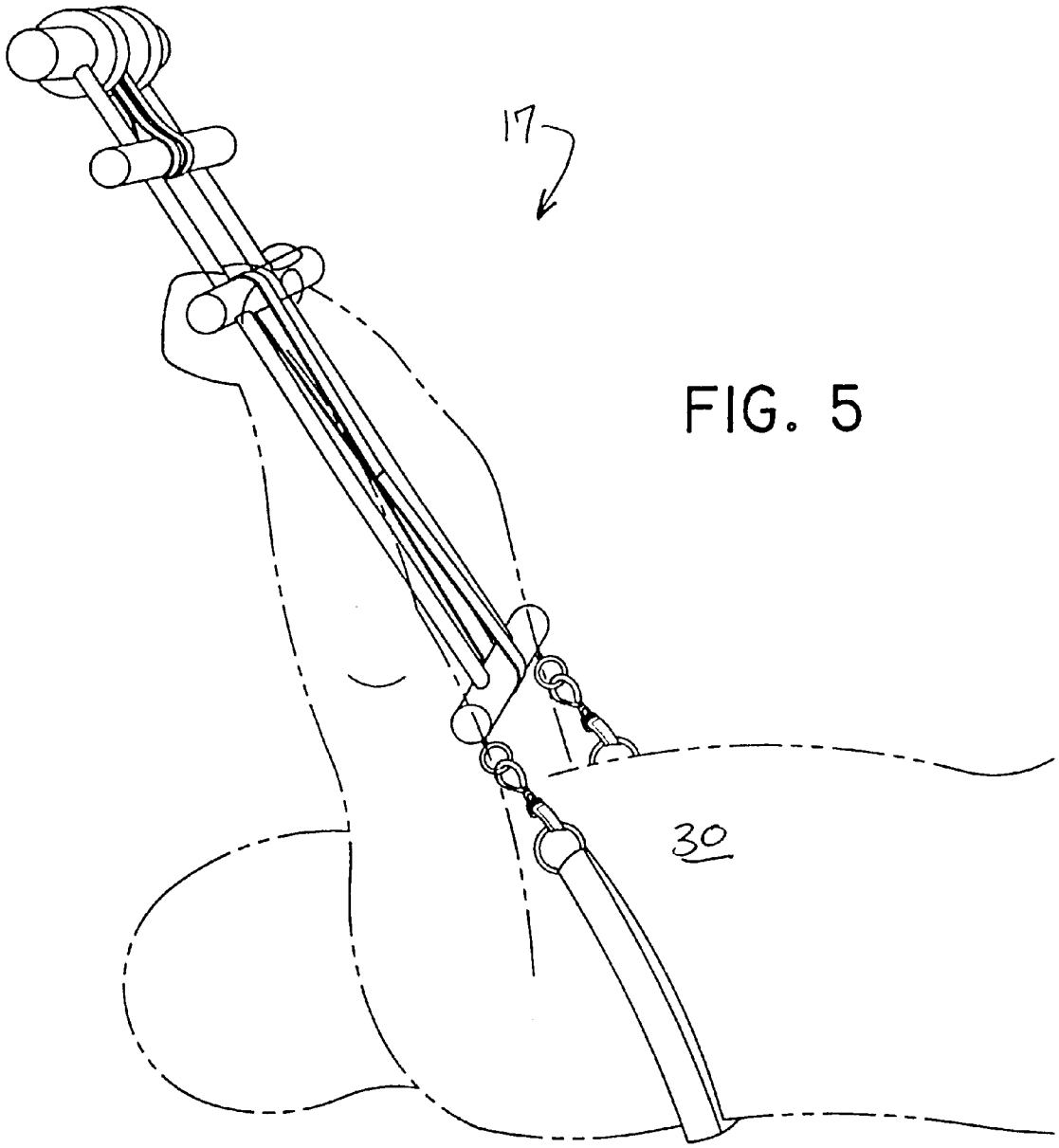
FIG. 5 is an illustrative perspective view of a horizontal press exercise using the exercise apparatus of FIG. 1.

With reference to FIGS. 5–9, exercise apparatus 30 is designed to perform a multitude of varying specific exercises and preferably includes such exercises colloquially known as the horizontal press 17, sitting curls 18, downward press 19, upside-down pull-ups 20 and stomach crunches 21. As shown in FIG. 5, the horizontal press exercise 17 is performed utilizing strap pad harness 13 in conjunction with exercise apparatus 30. In operation, a user lays upon a flat comfortable surface and places the strap pad 13 under his shoulders. The snap hooks 12 are then attached to eyelets 11 of rigid member 1. The strap pad harness 13 is adjusted so that rigid member 1 snugly fits around the chest of the user. The user next applies a firm grip around the grasping ends of rigid member 2 and presses up toward rigid member 4 until rigid member 2 touches rigid member 4. The user then returns to the starting position to complete one repetition of the horizontal press 17. As with any physical exercise, the number of repetitions and sets to be performed by the user is dependent on his physical ability and health. With reference to the present disclosure, a single repetition of each physical exercise 17–27 will be described, however, it is contemplated that each exercise can include any number of partial or complete repetitions or sets.

Figure 6:
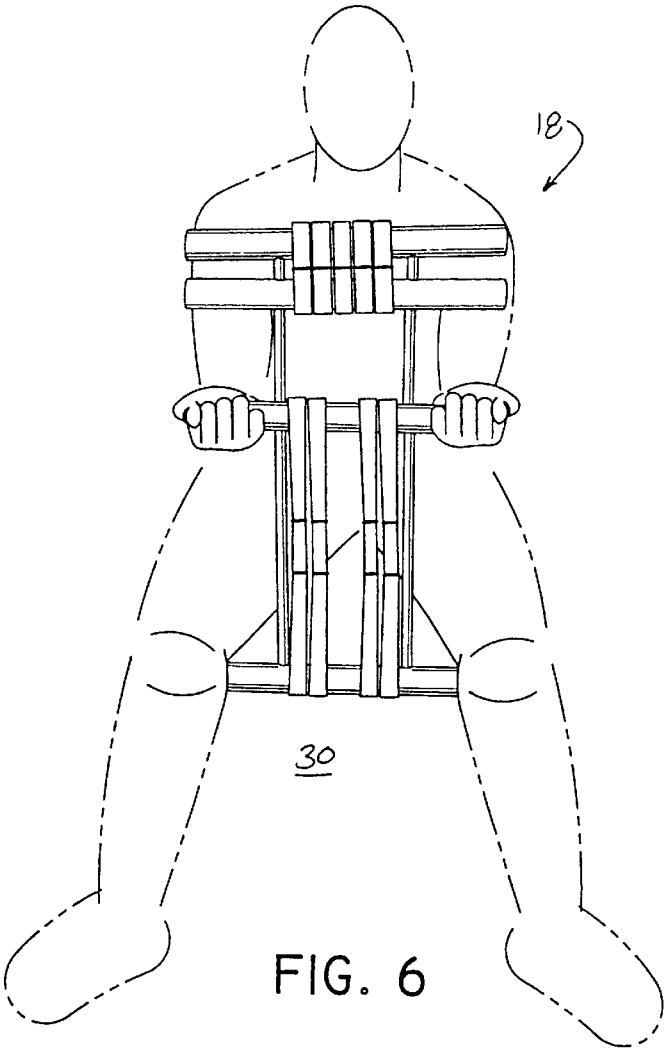
FIG. 6 is an illustrative view of a sitting curls exercise using the exercise apparatus of FIG. 1.

With reference to FIG. 6, the sitting curls exercise 18 uses exercise apparatus 30 without the aid of strap pad harness 13. In operation, the user sits on the edge of a chair or bench and place rigid member 1 under and rigid member 2 over his thighs. Next, the user places an underhand grip around the grasping ends of rigid member 2 and with his back in a straightened position, pulls the rigid member 2 up until rigid member 2 touches rigid member 4, pauses for a moment and then returns to the starting position. This action completes one repetition of the sitting curls exercise 18.

Figure 7:
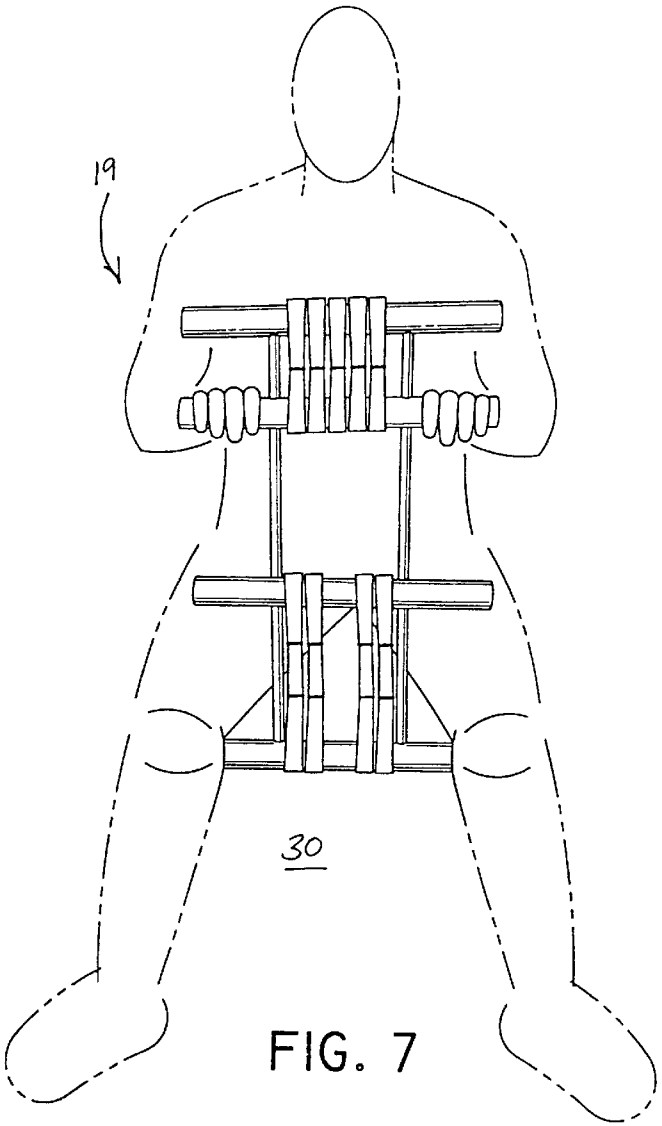
FIG. 7 is an illustrative view of a downward press exercise using the exercise apparatus of FIG. 1.

Similarly at FIG. 7, for the downward press exercise 19 the user, while in the same position as with the sitting curls exercise 18, provides an overhand grasp of the grasping ends of rigid member 4. The user then pushes down on rigid member 4 toward rigid member 2, until rigid member 4 touches rigid member 2. The user then returns to the starting position to complete one repetition of the downward press exercise 19.

Figure 8:
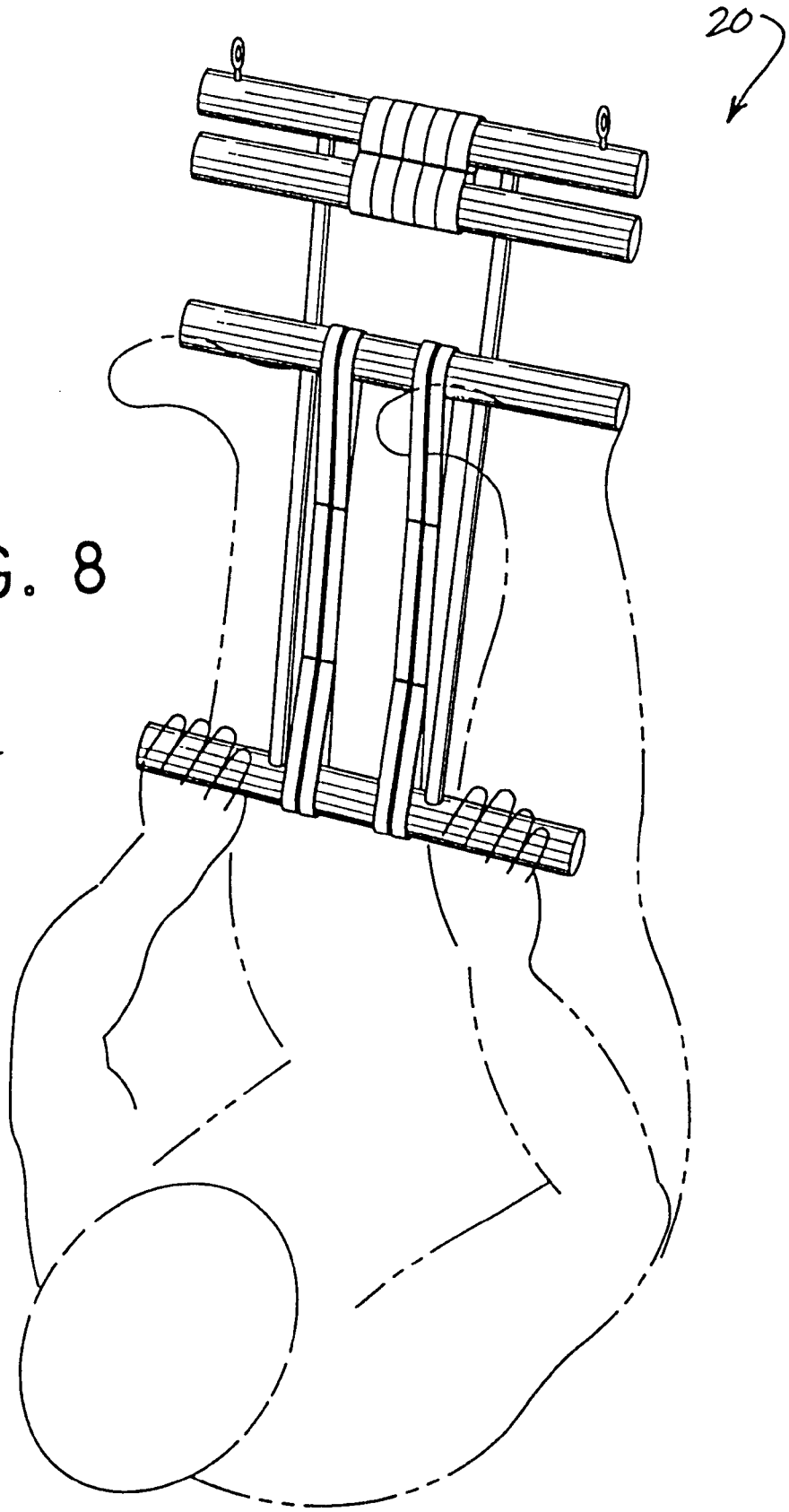
FIG. 8 is an illustrative view of an upside-down pull-ups exercise using the exercise apparatus of FIG. 1.

As shown in FIG. 8, the upside-down pull-ups exercise 20 uses exercise apparatus 30 without the aid of strap pad harness 13. In operation, the user lays upon a flat comfortable surface with his legs positioned vertically in the air. The user places an overhand grip around the grasping ends of rigid member 3 and positions his feet under the grasping ends of rigid member 4, wherein his feet are placed between rigid members 3 and 4 and outside the area defined between guide members 5 and 6. Once in this position, the user straightens his legs, locks his knees and pulls down on rigid member 3 toward his chest. The user pulls down on rigid member 3 as far as desired and then returns to the starting position to complete one repetition of the upside-down pull-ups exercise 20.

Figure 9:
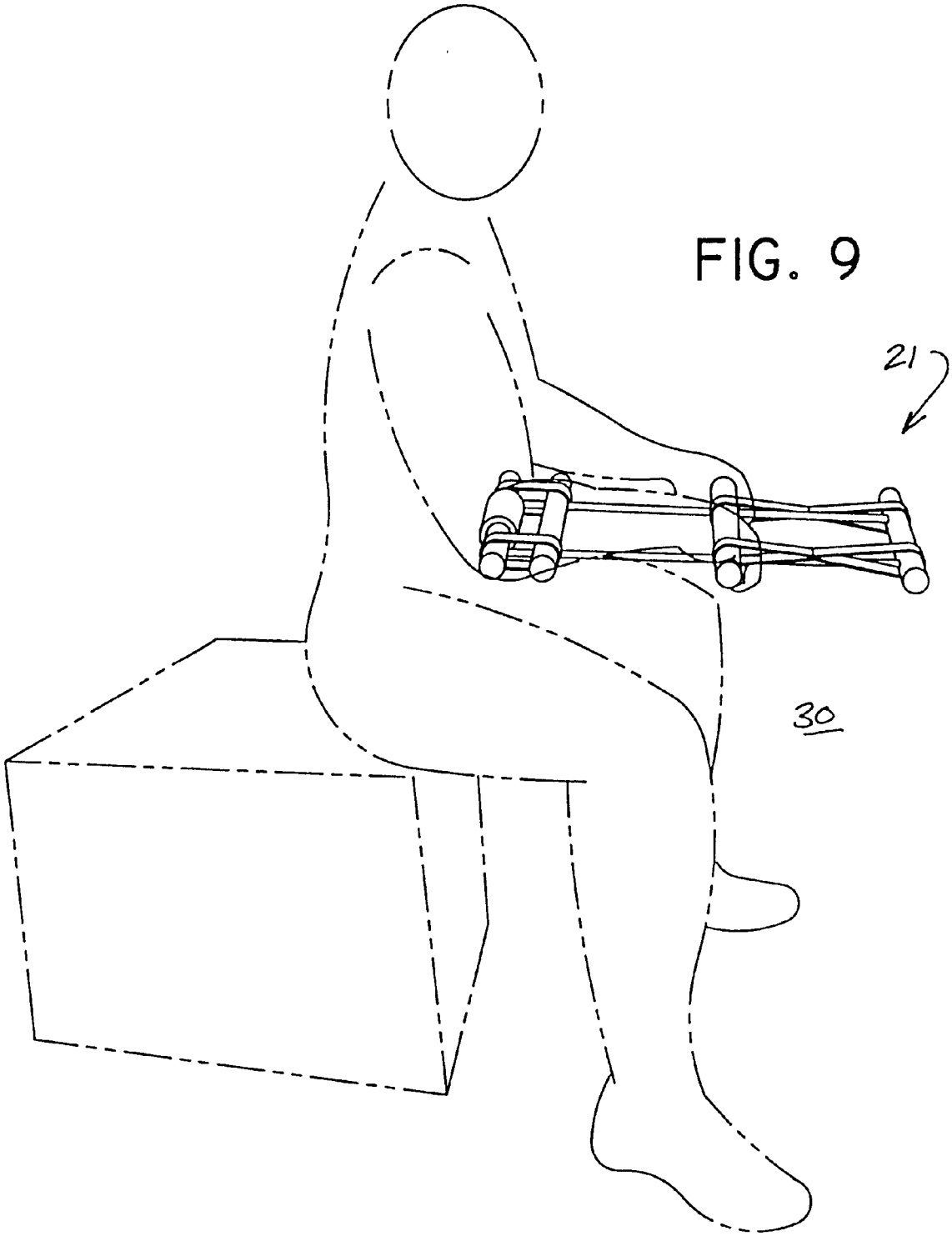
FIG. 9 is an illustrative view of a stomach crunch exercise using the exercise apparatus of FIG. 1.

With reference to FIG. 9, the stomach crunches exercise 21 uses exercise apparatus 30 without the aid of strap pad harness 13. In operation, the user sits on the edge of a chair or bench and places rigid member 3 including cushioning member 10 firmly against his stomach. The user places an overhand grip around the grasping ends of rigid member 2 and slowly pulls rigid member 2 toward his stomach while keeping his abdominal muscles tightened as the resistance against rigid member 2 increases. The user then returns to the starting position to complete one repetition of the stomach crunches exercise 21.

Figure 10:
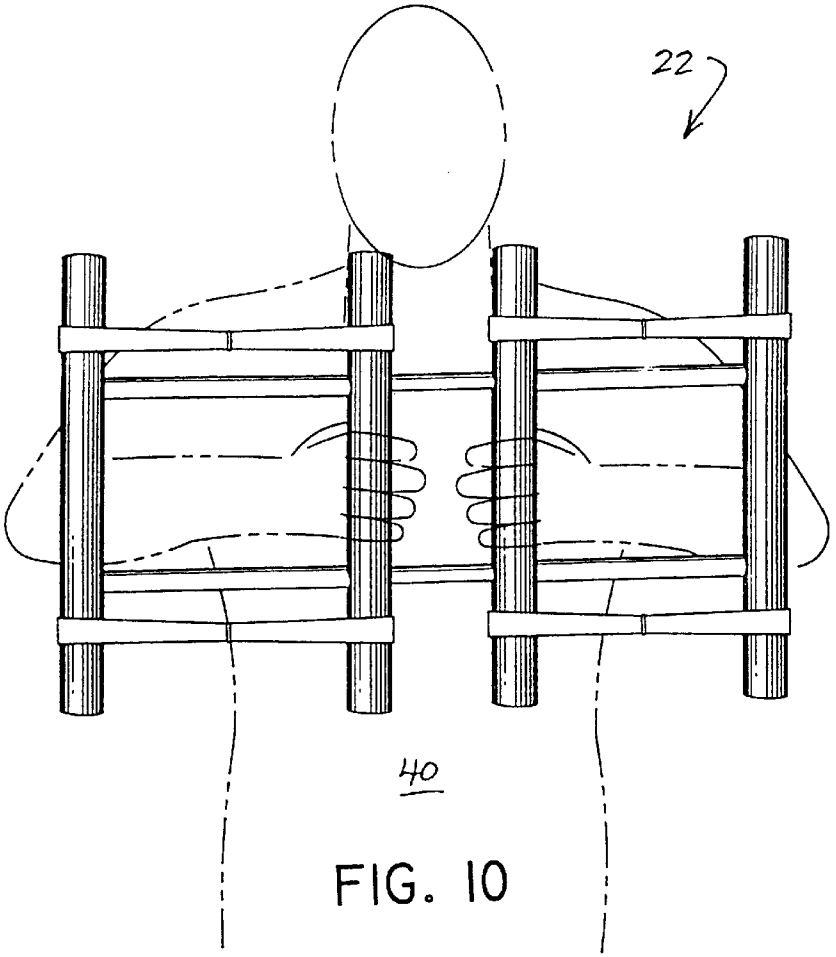
FIG. 10 is an illustrative view of an arm crunch exercise using the exercise apparatus of FIG. 3.

The arm crunches exercise 22 utilizes exercise apparatus 40 as is shown in FIG. 10. In operation, the user takes one hand and positions it between rigid members 3 and 4 while grasping a center portion of rigid member 4. Next, the user takes his other hand and positions it between rigid members 1 and 2 while grasping a center portion of rigid member 2. While having the exercise apparatus 40 positioned in front of his chest, the user pushes his hands toward one another until they touch and then returns them to the starting position. This action completes one repetition of the arm crunches exercise 22. With reference to exercise apparatus 40, it is contemplated that, in addition to the arm crunches exercise 22, the exercise apparatus 40 can also be used to perform the aforementioned sitting curls 18, downward press 19, upside-down pull-ups 20 and stomach crunches 21 exercises.

Figure 11:
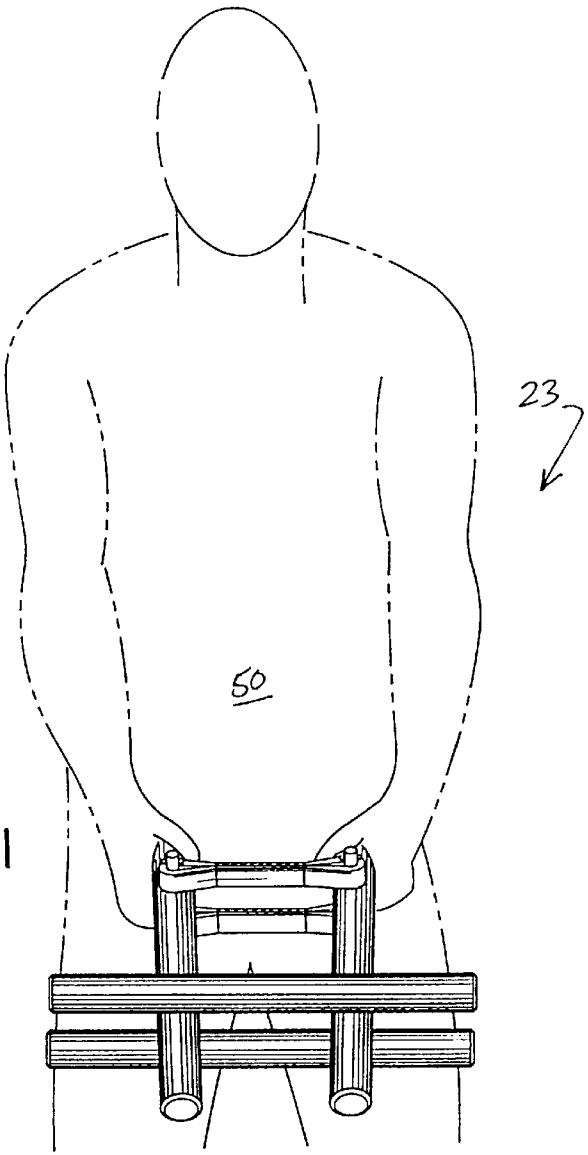
FIG. 11 is an illustrative view of a standing butterflies exercise using the exercise apparatus of FIG. 4.

With reference to FIGS. 11–16, exercise apparatus 50 is designed to perform a multitude of varying specific exercises and preferably includes such exercises colloquially known as the standing butterfly 23, behind-the-back-butterfly 24, seated chest crunches 25, seated butterfly 26 and forearm crunches 27. As shown in FIG. 11, the standing butterflies exercise 23 is performed while the user is in a standing position. In operation, the user grasps rigid members 2 and 4 at the upper grasping ends 29 and points the opposite end of the exercise apparatus 50 toward the floor. The user next locks his arms in an extended position and proceeds to pull apart rigid members 2 and 4 as far as desired and then returns to the starting position. This action completes one repetition of the standing butterfly exercise 23.

Figure 12:
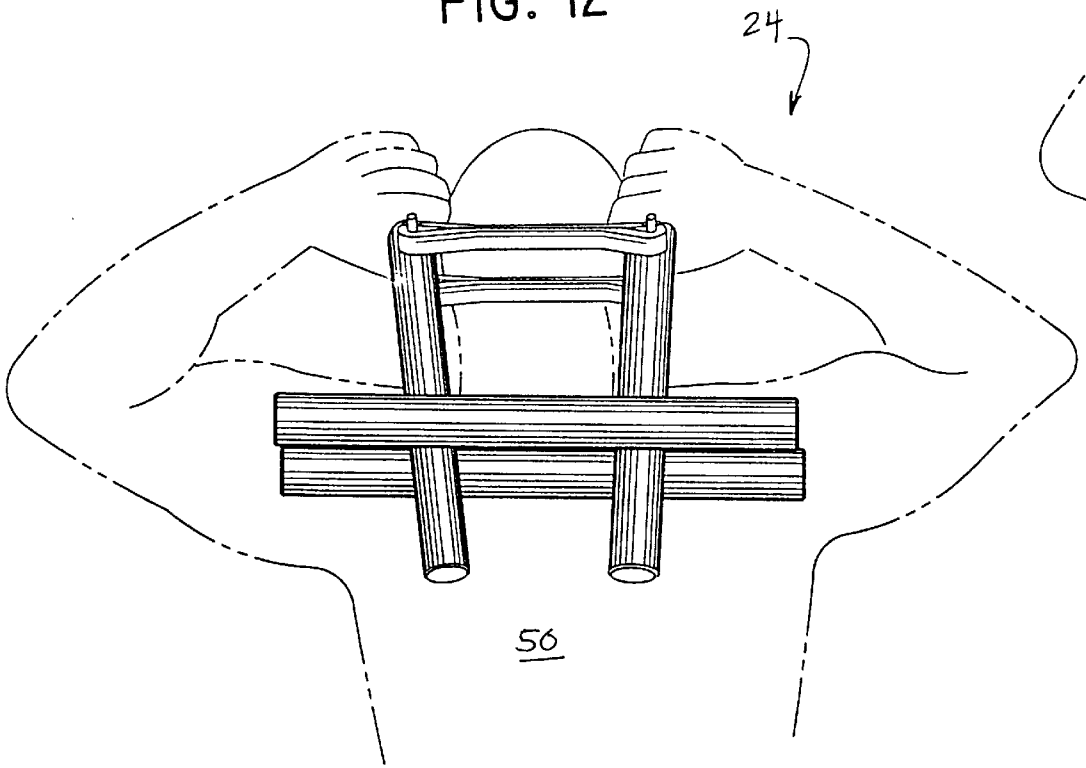
FIG. 12 is an illustrative view of a behind-the-back-butterflies exercise using the exercise apparatus of FIG. 4.

Similarly as shown in FIG. 12, the behind-the-back-butterfly exercise 24 is performed from a standing position with legs spread apart to shoulder width. In operation, the user grasps the upper grasping ends 29 of rigid members 2 and 4 and positions the exercise apparatus 50 on his shoulder blades, as is shown in FIG. 12. The exercise involves pulling apart rigid members 2 and 4 as far as desired and then returning to the starting position to complete one repetition of the behind-the-back-butterfly exercise 24.

Figure 13:
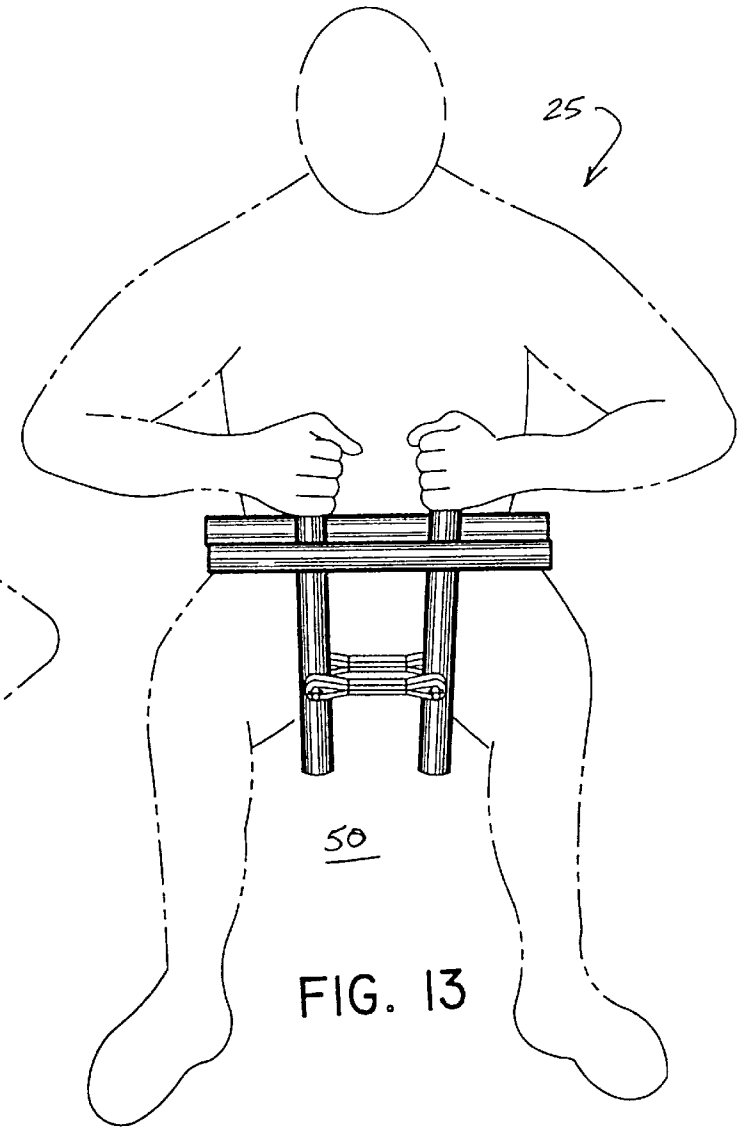
FIG. 13 is an illustrative view of a seated chest crunch exercise using the exercise apparatus of FIG. 4.

With reference to FIG. 13, the seated chest crunches 25 is performed using exercise apparatus 50. In operation, the user sits on the edge of a chair or bench and places rigid members 1 and 3 on top of his thighs with rigid members 2 and 4 disposed between his legs and with the upper grasping ends 29 pointed toward the floor. The user grasps the lower grasping ends 31 of rigid member 2 and 4, leans forward over the exercise apparatus 50, presses or pushes the rigid members 2 and 4 toward each other, holds the rigid members 2 and 4 together for several seconds and then releases and returns to the starting position to complete a single repetition of the seated chest crunches 25.

Figure 14:
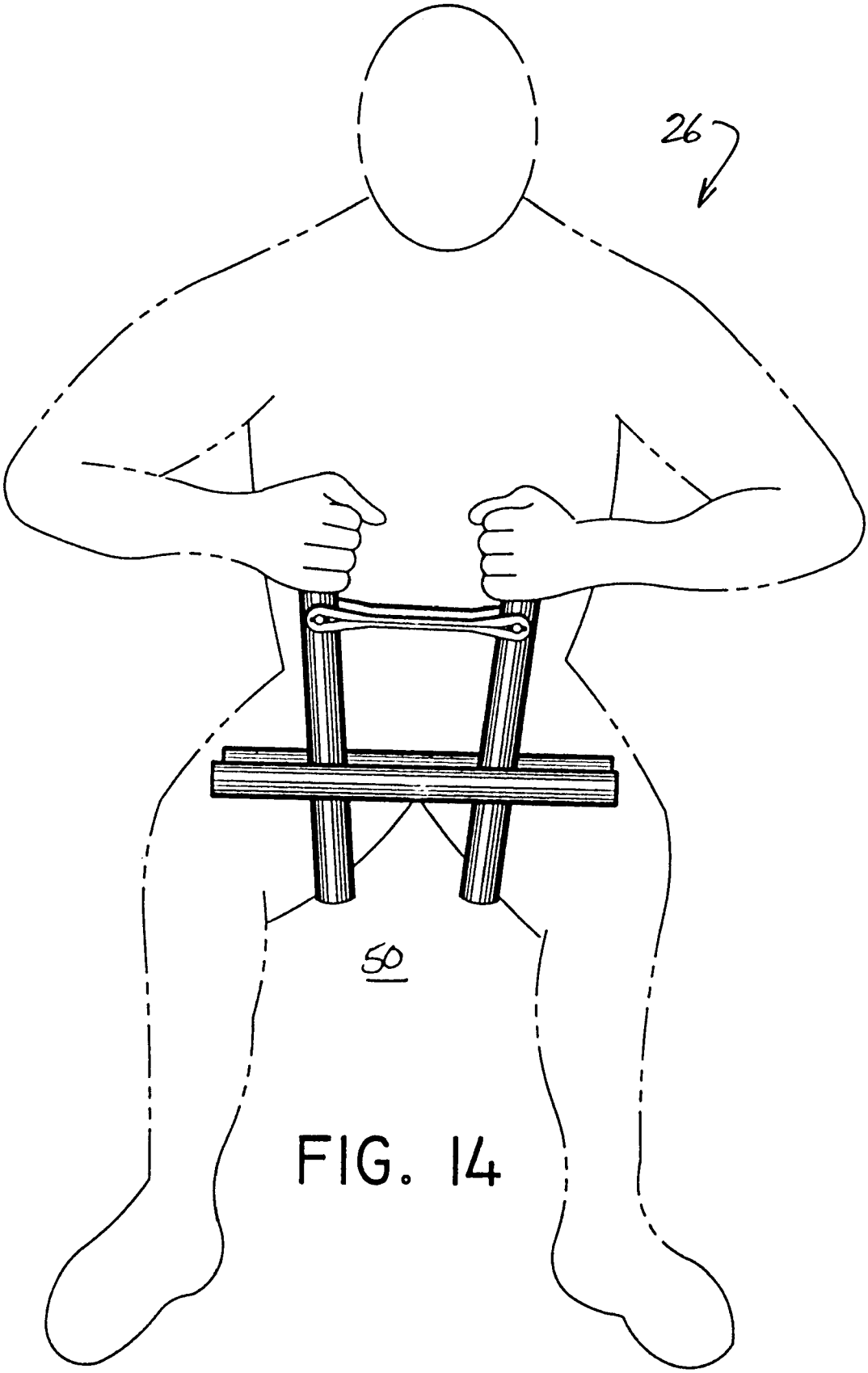
FIG. 14 is an illustrative view of a seated butterflies exercise using the exercise apparatus of FIG. 4.

Similarly, as shown in FIG. 14, the seated butterfly exercise 26 is performed with the user seated on the edge of a chair or bench. The exercise apparatus 50 is positioned so that rigid members 1 and 3 are placed on top of the user's thighs with rigid members 2 and 4 disposed between his legs and with the lower grasping ends 31 pointed toward the floor. The user grasps the upper grasping ends 29 of rigid member 2 and 4 and with his arms locked in a straight position pulls rigid members 2 and 4 apart as far as desired and then releases and returns to the starting position to complete one repetition of the seated butterfly 26.

Figure 15:
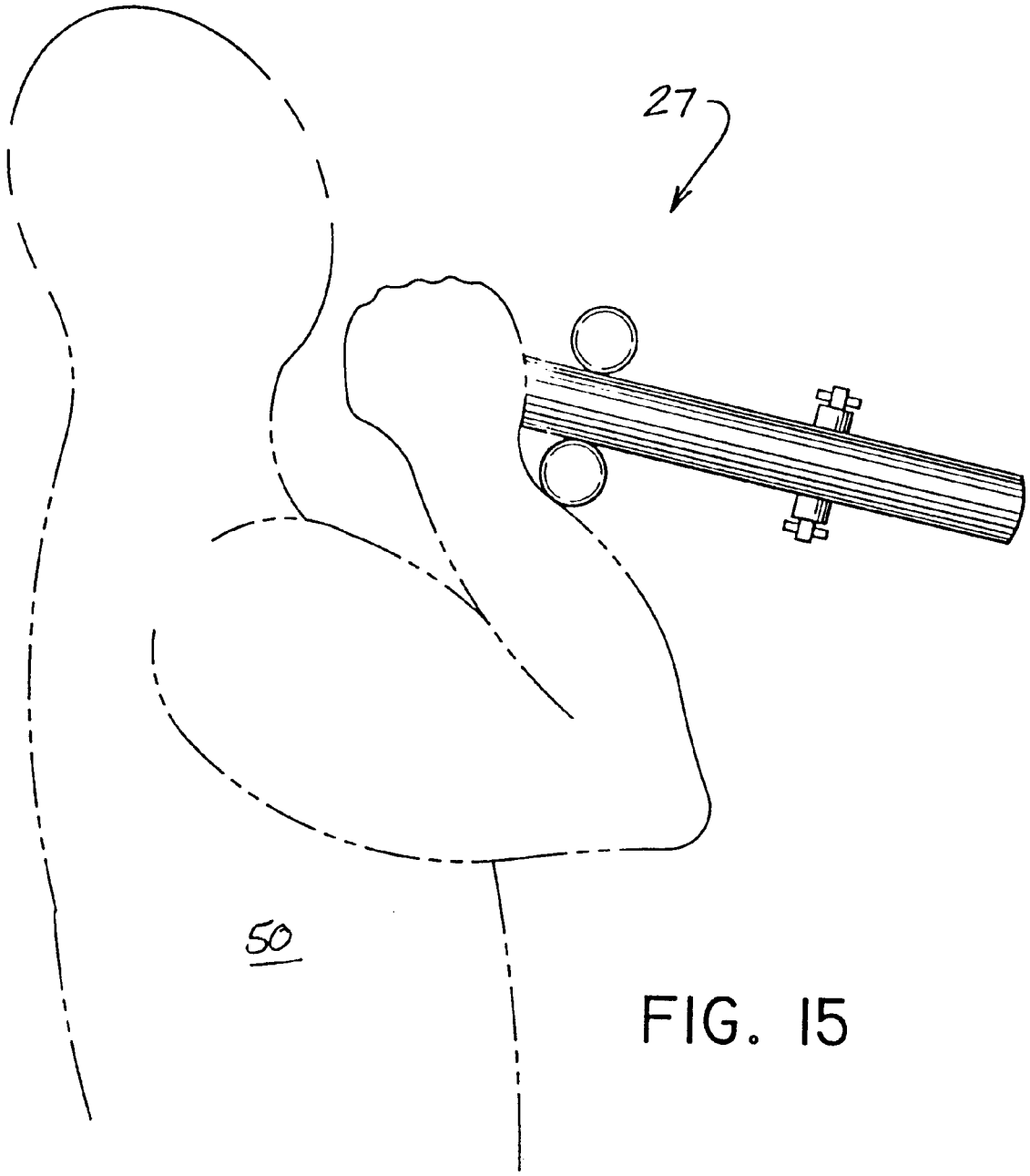
FIG. 15 is an illustrative view of a forearm crunches exercise using the exercise apparatus of FIG. 4.

With reference to FIG. 15, the forearm crunches exercise 27 is performed while the user is in a standing position. In operation, the user grasps the lower grasping ends 31 of rigid members 2 and 4 and rests the exercise apparatus 50 on his wrists with the opposite end of the exercise apparatus 50 pointed away from the user. The user next squeezes his elbows together until they are almost touching and then presses rigid members 2 and 4 toward each other by movement of only his hands and wrists. The rigid members 2 and 4 are then returned to the starting position to complete a single repetition of the forearm crunches exercise 27.

Figure 17:
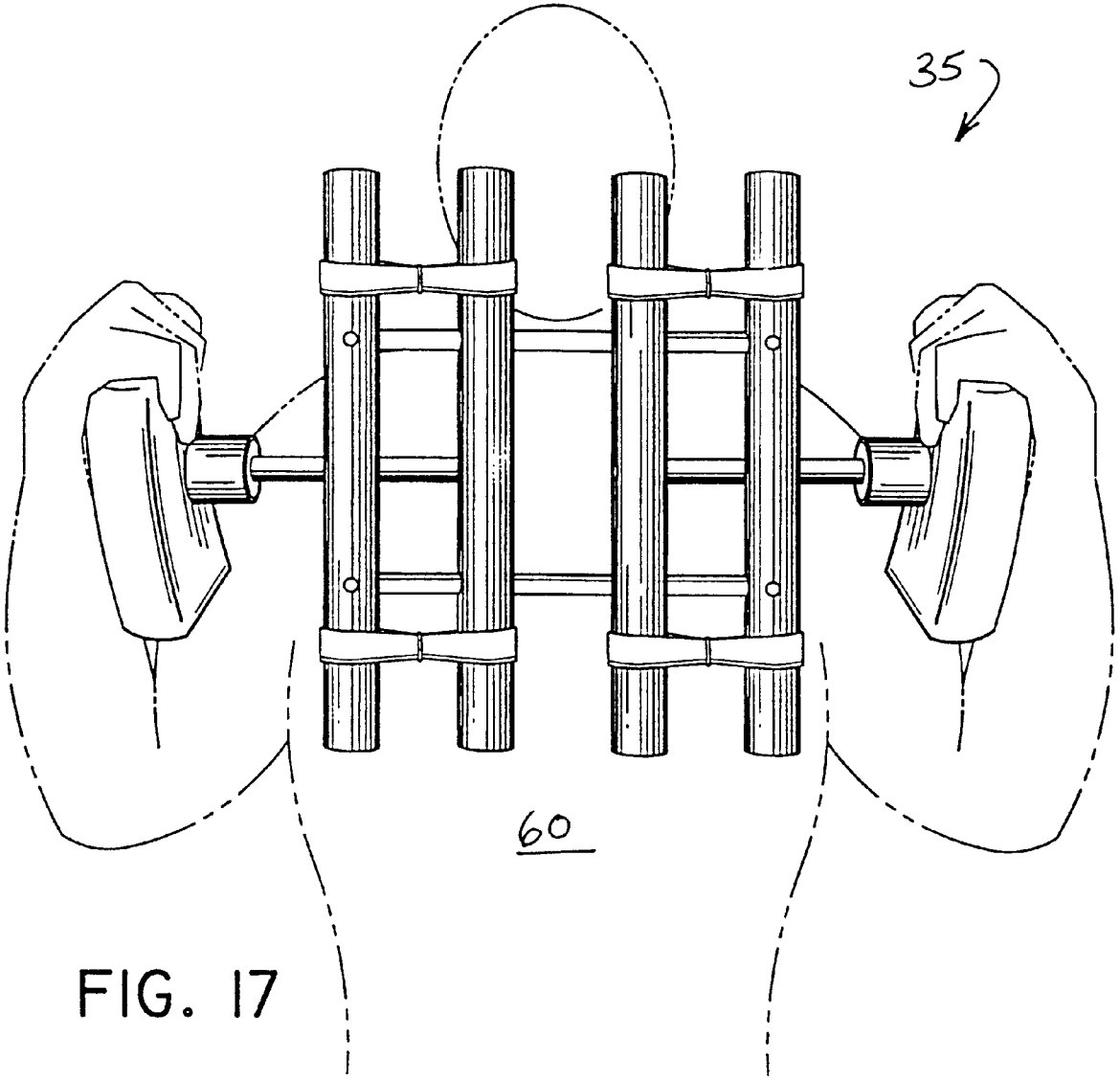
FIG. 17 is an illustrative view of a butterfly press exercise using the exercise apparatus of FIG. 16.

With reference to FIG. 17, exercise apparatus 60 is designed to perform varying specific exercises and preferably includes an exercise colloquially known as the butterfly press 35. The butterfly press 35 is performed with associated pad members 32 in conjunction with exercise apparatus 60. In operation, the user takes both hands and partial forearms and positions them over pad members 32. While having the exercise apparatus 60 positioned in front of his chest, the user pushes his hands and forearms toward one another to a desired point and then returns them to the starting position. This action completes one repetition of the butterfly press exercise 35.

Figure 19:
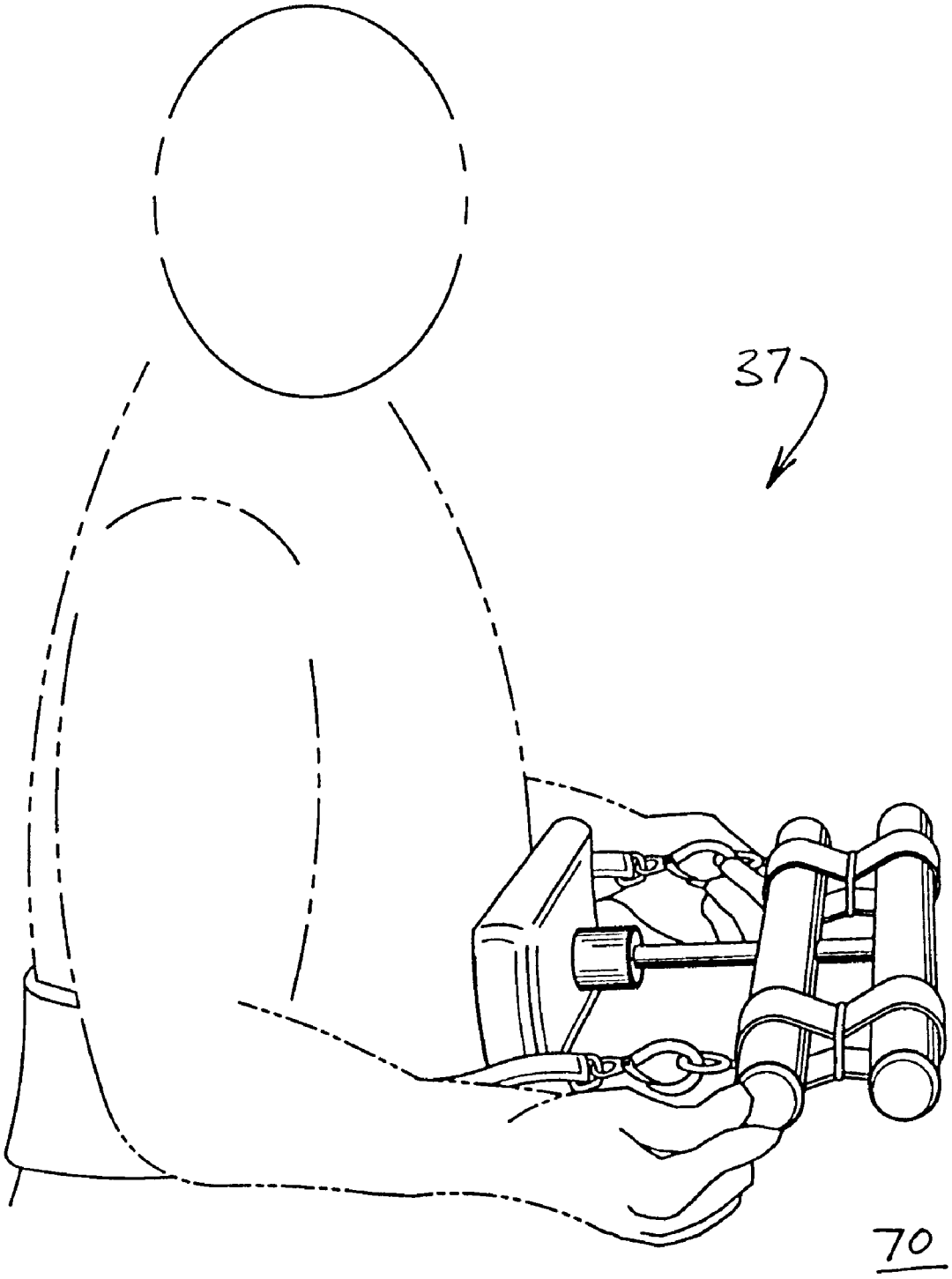
FIG. 19 is an illustrative view of an abdominal press exercise using the exercise apparatus of FIG. 18.

With reference to FIG. 19, exercise apparatus 70 is designed to perform varying specific exercises and preferably includes an exercise colloquially known as the abdominal press exercise 37. The abdominal press exercise 37 uses exercise apparatus 70 with the aid of strap pad harness 13. In operation, the user places strap pad harness 13 securely around his waist and pad member 32 against his abdominal area. Next, the user grips the grasping ends 28 of rigid member 1 and slowly pulls rigid member 1 toward his stomach while keeping his abdominal muscles tightened as the resistance against rigid member 2 and his abdominal muscles increases. The user then returns to the starting position to complete one repetition of the stomach press exercise 37.

It will be understood that various modifications may be made to the embodiments disclosed herein. For example, the exercise apparatuses of the present disclosure may also be used in numerous other specific physical exercises which require the use of isometric strengthening through the physical pushing and/or pulling of the rigid members. Therefore, the above description should not be construed as limiting, but merely as exemplifications of preferred embodiments. Those skilled in the art will envision other modifications within the scope and spirit of the claims appended hereto.

What is claimed is:

1. A multi-configurable exercise apparatus comprising:

a first pair of elongate rigid members including a first and second rigid member;

a second pair of elongate rigid members including a first and second rigid member;

the first pair of elongate rigid members coupled to the second pair of elongate rigid members by a pair of guide members; and the first and second rigid members of each pair of rigid members being separated by at least one elastic member for providing variable resistance between each first rigid member and respective second rigid member.

2. The multi-configurable exercise apparatus according to claim 1, wherein each rigid member and each guide member is substantially circular in cross-section.

3. The multi-configurable exercise apparatus according to claim 1, wherein each rigid member is substantially of equal cross-section and substantially of equal length.

4. The multi-configurable exercise apparatus according to claim 1, wherein the pair of guide members completely transect at least one pair of rigid members.

5. The multi-configurable exercise apparatus according to claim 1, wherein the pair of guide members are fixedly attached to at least one pair of rigid members.

6. The multi-configurable exercise apparatus according to claim 1, further including at least one attachment member coupled to at least one pair of elongate rigid members.

7. The multi-configurable exercise apparatus-according to claim 6, wherein each attachment member further includes a pad, the pad providing support to a user of the exercise apparatus.

8. A multi-configurable exercise apparatus comprising:

a first pair of parallel spaced elongate rigid members including an outer and an inner rigid member;

a second pair of parallel spaced elongate rigid members including an outer and an inner rigid member;

the first pair of elongate rigid members coupled to the second pair of elongate rigid members by a pair of elongate guide members parallel spaced and transverse to the first and second pairs of rigid members; and the outer and inner rigid members of each pair of rigid members being separated by at least one elastic member for providing variable resistance between each inner member and respective outer member.

9. The multi-configurable exercise apparatus according to claim 8, further including a strap coupled to at least one of the outer rigid members, the strap providing support to a user of the exercise apparatus.

10. The multi-configurable exercise apparatus according to claim 9, wherein the strap includes a padded section.

11. The multi-configurable exercise apparatus according to claim 8, further including a cushioned support along at least one of the outer rigid members.

12. The multi-configurable exercise apparatus according to claim 8, wherein each guide member completely transect at least two rigid members.

13. The multi-configurable exercise apparatus according to claim 8, wherein each guide member is fixedly attached to at least two rigid members.

14. A multi-configurable exercise apparatus comprising:

a first pair of parallel spaced elongate rigid members;

a second pair of elongate rigid members including a first and second rigid member, wherein the second pair of rigid members are disposed between the first pair of rigid members;

the first pair of rigid members coupled to the second pair of elongate rigid members by locking guide members;

the first and second rigid members including at least one transversely coupled fastening guide member; and the fastening guide members of the first and second rigid members being separated by at least one elastic member for providing variable resistance between the first and second rigid members.

15. The multi-configurable exercise apparatus according to claim 14, wherein the second pair of elongate rigid members are rotationally coupled to the first pair of elongate rigid members.

16. The multi-configurable exercise apparatus according to claim 14, wherein each rigid member and each guide member is substantially circular in cross-section.

17. The multi-configurable exercise apparatus according to claim 14, further including upper and lower grasping ends along the first and second rigid members, wherein a grasping force is applied to at least two of the grasping ends to perform a physical exercise.

18. The multi-configurable exercise apparatus according to claim 17, wherein the grasping force draws at least two of the grasping ends toward each other.

19. The multi-configurable exercise apparatus according to claim 17, wherein the grasping force draws at least two of the grasping ends away from each other.

* * * * *